US005188354A

United States Patent [19]

Emori

[11] Patent Number: 5,188,354

[45] Date of Patent: Feb. 23, 1993

[54] PAPER STORAGE DEVICE

[75] Inventor: Kiyoshi Emori, Toyokawa, Japan

[73] Assignee: Minolta Camera Kabushiki Kaisha, Osaka, Japan

[21] Appl. No.: 643,184

[22] Filed: Jan. 18, 1991

[30] Foreign Application Priority Data

Jan. 20, 1990 [JP] Japan ..... 2-11478

[51] Int. Cl.[5] ..... B65H 31/10

[52] U.S. Cl. ..... 271/217; 271/176

[58] Field of Search ..... 271/176, 215, 217

[56] References Cited

U.S. PATENT DOCUMENTS

| | | | |
|---|---|---|---|
| 3,682,328 | 8/1972 | Turner et al. | 214/6 H |
| 4,229,650 | 10/1980 | Takahashi | 271/215 X |
| 4,718,657 | 1/1988 | Otter et al. | 271/184 |
| 4,927,131 | 5/1990 | Hashimoto | 271/215 |
| 4,959,685 | 9/1990 | Kato | 355/72 |

FOREIGN PATENT DOCUMENTS

| | | |
|---|---|---|
| 60-137764 | 7/1985 | Japan . |
| 61-206769 | 9/1986 | Japan . |

*Primary Examiner*—Richard A. Schacher

*Attorney, Agent, or Firm*—Willian Brinks Olds Hofer Gilson & Lione

[57] ABSTRACT

A paper storage device comprises a sensor for generating a detection signal indicative of the arrival of a top level of a stack of papers on a paper support tray at a predetermined height so that the paper support tray can be lowered in response to the detection signal, and a counter for counting the number of papers successively stacked on the paper support tray so that an indication that the paper support tray is held at an improper position can be provided when the counter counts a predetermined number of the papers during the absence of the detection signal from the sensor. Once the top level of the paper stack on the paper support tray has attained the uppermost limit position, the top level of the paper stack on the paper support tray is lowered to a lowermost limit position to secure the orderly disposition.

9 Claims, 8 Drawing Sheets

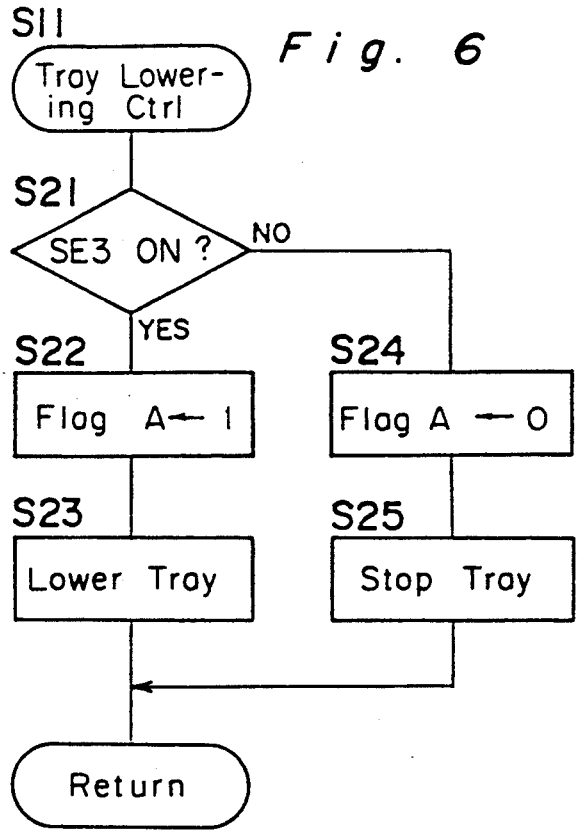
Fig. 6
Fig. 7
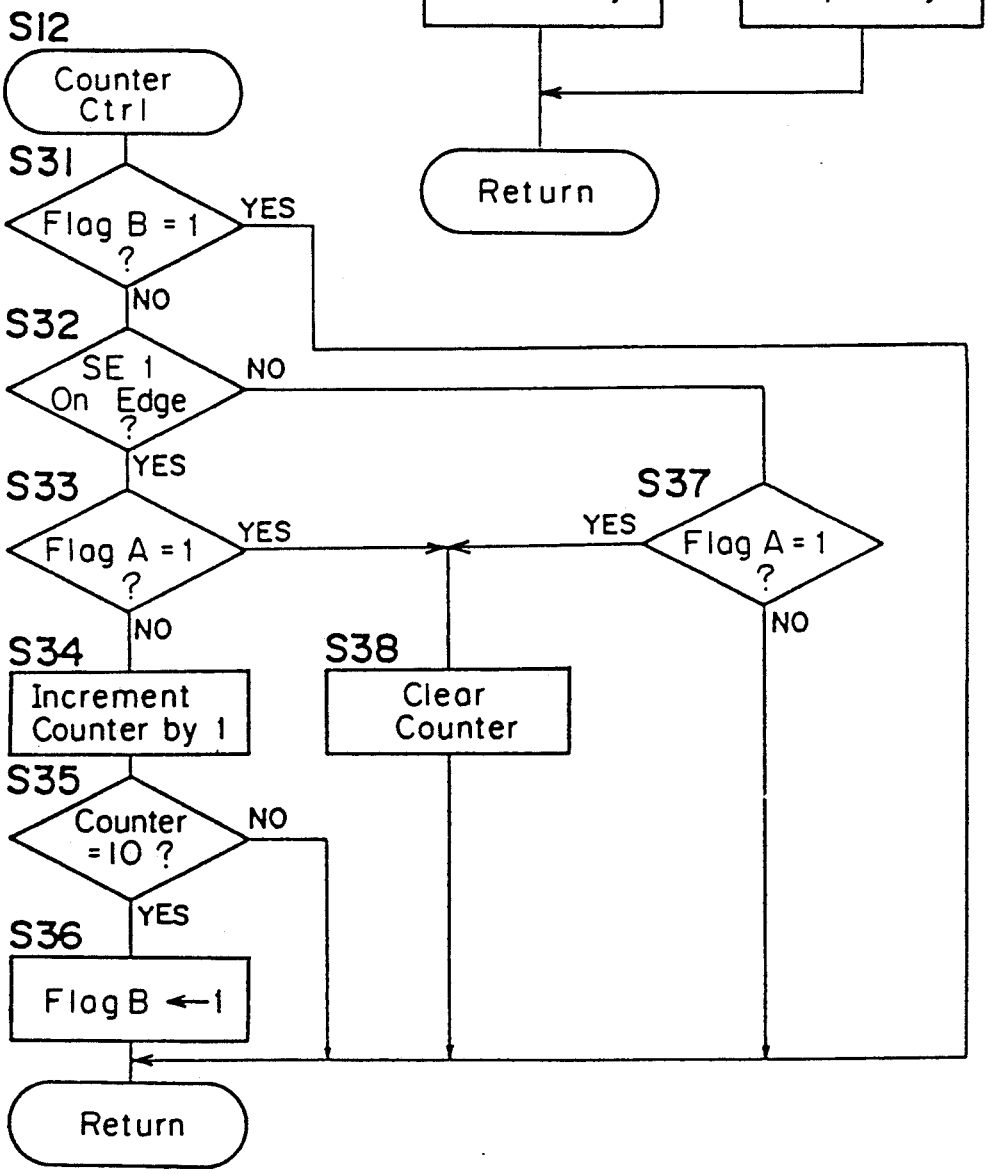

PAPER STORAGE DEVICE

BACKGROUND OF THE INVENTION

1. Field of the Invention

The present invention generally relates to a paper storage device and more particularly to the paper storage device used in an image forming apparatus such as, for example, an electrophotographic copying machine or a laser printer for accommodating, in a stacked fashion papers which are successively discharged from the image forming apparatus.

2. Description of the Prior Art

A laser printer is usually used for making a large number of copies from a single document at one time and, therefore various paper storage devices have been proposed such as having a tray of relatively large capacity or stackers. In general, the paper storage device of the type used in association with the laser printer comprises at least one paper support tray supported for stepwise movement between lowered and elevated positions. The paper support tray is generally held at the elevated position and is stepwise moved down to the lowered position according to the payload on the paper support tray, that is, the number or weight of the papers discharged from the laser printer onto the paper support tray. It is necessary to descend the paper support tray according to the payload imposed thereon for maintaining the distance, that is 'drop height' between a nip of a pair of discharge rollers and a surface of papers stacked on the paper support tray constantly in order to achieve good disposition of paper discharged from the laser printer onto the paper support tray.

If an operator of the laser printer removes a portion of the stack of the papers from the paper support tray while the laser printer is in process of producing copies, the level of the uppermost one of the papers remaining on the paper support tray lowers and, hence, the drop height referred to above becomes larger. Once this occurs, a problem associated with a loss of orderly disposition of the papers on the paper support tray tends to occur.

In view of the foregoing, the prior art is such that the use of either upper and lower limit switches for detecting the arrival of the paper support tray at elevated and lowered positions, respectively, or a detector switch for detecting the surface of the uppermost one of the stack of the papers on the paper support tray, has been made to control the movement of the paper support tray in dependence on the state of one of those upper and lower limit switches or the state of the detector switch. See the Japanese Laid-open Patent Publication No. 00-137764, published in 1985, and U.S. Pat. No. 4,959,685.

However, according to any one of those prior art systems, when a drive means is driven always according to a change in drop height above the uppermost one of the papers, stacked on the paper support tray, to move the paper support tray between the elevated and lowered positions, they have problems associated with durability noises and others and, therefore, require the use of a structure for monitoring the position of the uppermost one of the stacked papers at all times.

SUMMARY OF THE INVENTION

Accordingly, the present invention is intended to provide an improved paper storage device employing simplified paper detecting means wherein when a portion of the stack of the papers on the paper support tray is removed, the orderly disposition of the papers subsequently discharged onto the paper support tray can be harmonized with the load imposed on the drive means for the paper support tray.

In order to accomplish the above described object, the paper storage device according to the present invention makes use of a detecting means for generating a detection signal indicative of the arrival of a top level of the stack of the papers on the paper support tray at a predetermined height so that the paper support tray can be lowered in response to the detection signal. The paper storage device also makes use of a count means for counting the number of papers successively stacked on the paper support tray so that an indication that the paper support tray is held at an improper position can be provided when the count means counts a predetermined number of the papers during the absence of the detection signal from the detecting means.

When a pair of discharge rollers are employed for discharging the papers successively onto the paper support tray, the drop height as measured from the nipping region of the discharge roller pair and the uppermost one of the papers stacked on the paper support tray that is, the top level of the stack of the papers on the paper support tray, is an important factor to be considered for accomplishing the orderly disposition of the papers successively discharged onto the paper support tray. Therefore, the predetermined height referred to above and detected by the detecting means is intended to means an uppermost limit position for the top level of the stack of the papers on the paper support tray to occupy for accomplishing the orderly disposition of the papers on the paper support tray. In general, once the top level of the paper stack on the paper support tray has attained the uppermost limit position, the top level of the paper stack on the paper support tray is lowered to a lowermost limit position to secure the orderly disposition. Accordingly, the paper support tray is generally retained at a proper position intermediate between the uppermost and lowermost limit positions for the top level of the stack of the papers resting on the paper support tray.

Should the top level of the paper stack on the paper support tray is lowered from the lowermost limit position as a result of the removal of a portion of the papers from the paper support tray, the position of the paper support tray will become improper. In such case, according to the present invention, the count means starts its counting operation to count the number of papers successively accommodated onto the paper support tray subsequent to the removal of that portion of the papers and, when the counted number of the papers has attained a predetermined value during the absence of the detection signal which ought to be generated by the detecting means, that is, during a period in which the top level of the paper stack on the paper support tray has not yet been reached the uppermost limit position, the paper support tray is deemed as held at the improper position. The predetermined count used as a basis for the determination of the improper positioning of the paper support tray may be determined in consideration of the thickness of each of papers frequently used, preferably that of each of papers actually used. In the event that the detecting means generates the detection signal before the count means counts the predetermined number of the papers, an usual lowering control is carried out to lower the paper support tray.

Thus, according to the present invention, even if the top level of the paper stack on the paper support tray is lowered below the lowermost limit position, a process of accommodating papers onto the paper support tray is continued before the count means counts the predetermined number thereof and, in the event that the top level of the paper stack has not yet been detected by the detecting means even after the count means counted the predetermined number thereof, it means that the top level of the paper stack on the paper support tray is abnormally lowered and, therefore, the position of the paper support tray is deemed improper. After the determination, it is preferred either to elevate the paper support tray so that the top level of the paper stack can be brought into alignment with the uppermost limit position for the proper positioning or to generate a warning signal so that the image forming operation of the image forming apparatus can be interrupted.

BRIEF DESCRIPTION OF THE DRAWINGS

This and other objects and features of the present invention will become clear from the following description taken in conjunction with preferred embodiments thereof with reference to the accompanying drawings, in which;

FIGS. 4 to 8 are flowcharts showing the sequence of operation of the paper storage device according to a first preferred embodiment of the present invention:

DETAILED DESCRIPTION OF THE EMBODIMENTS

Figure 1:
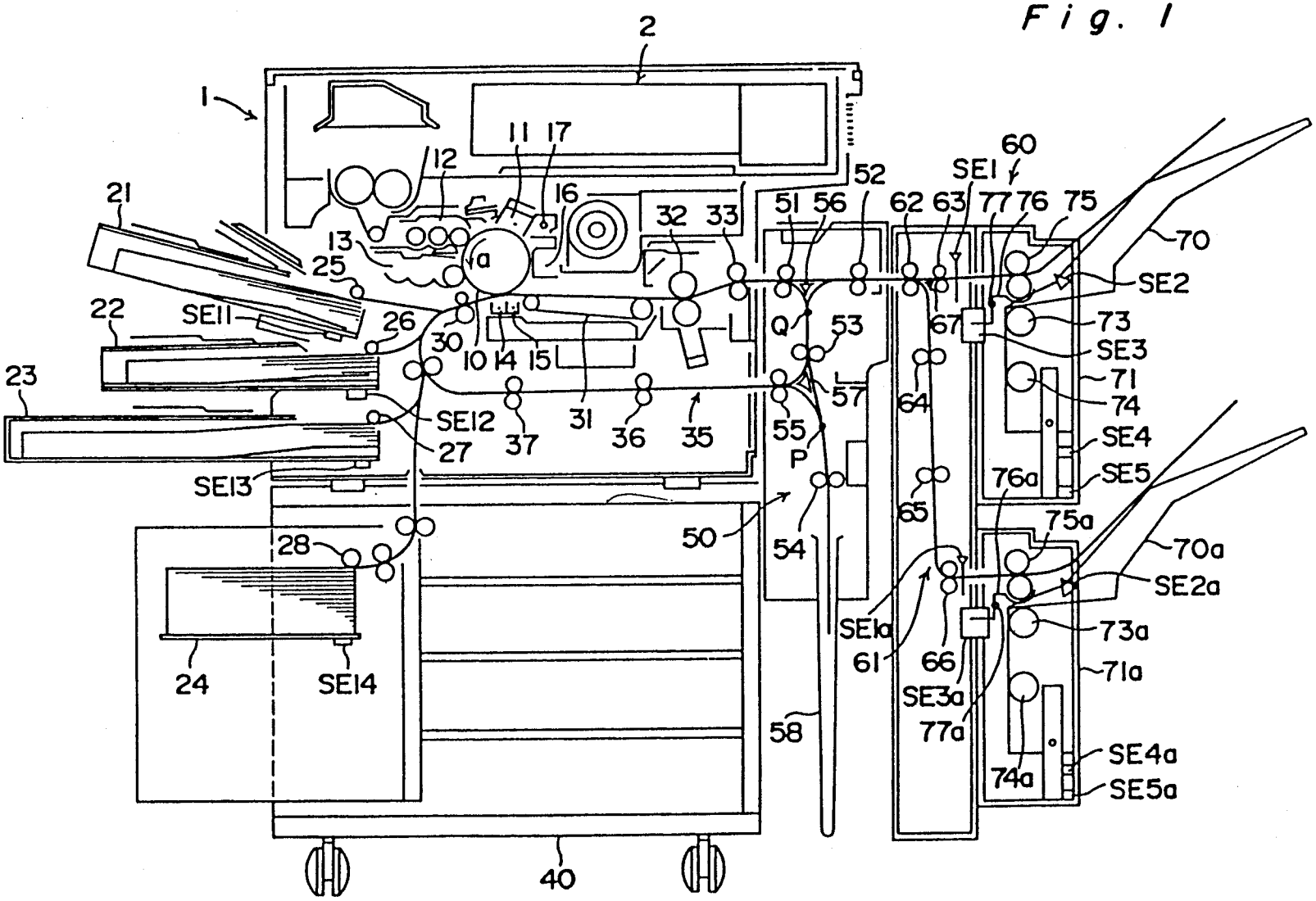
FIG. 1 is a schematic side view of a laser printer utilizing a paper storage device embodying the present invention.

Before the description of preferred embodiments of the present invention proceeds it is to be noted that like parts are designated by like reference numerals throughout the accompanying drawings.

First Embodiment: FIGS. 1 to 7

FIG. 1 illustrates a paper storage device 60 embodying the present invention, which is fitted to a laser printer 1 through a paper inverting unit 50.

The laser printer 1 is mounted on a desk 40 and includes a photoreceptor drum 10 supported at a generally central portion thereof for rotation in one direction shown by the arrow a. During each complete rotation of the photoreceptor drum 10, the latter can move past a plurality of processing stations defined in the vicinity of an outer peripheral surface thereof. These processing stations includes a charging station at which an electrostatic charger 11 is disposed for providing an electrostatic potential to the photoreceptor drum 10; a developing station at which developing units 12 and 13 of magnetic brush type are disposed for developing an electrostatic latent image, formed on the photoreceptor drum 10, into a visible powder image: a transfer station at which a transfer charger 14 is disposed for transferring the visible powder image on the photoreceptor drum 10 onto a recording paper supplied from one of automatic paper supply units 21, 22, 23 and 24; a separating station at which a separating charger 15 is disposed for separating the recording paper from the photoreceptor drum 10 after the transfer of the visible powder image from the photoreceptor drum 10 onto the recording paper; and a cleaning station at which a cleaning unit 10 and an eraser lamp 17 are disposed for removing residual toner and residue electrostatic charge remaining on the photoreceptor drum 10 in readiness for the next cycle of copying operation, respectively. Those component parts of the printer 1 are well known to those skilled in the art and, therefore, the details thereof are not reiterated herein for the sake of brevity.

The paper supply units 21, 22 and 23 are positioned one above the other at a left-hand portion of the machine and accommodate respective paper cassettes of different size, while the paper supply unit 24 is of a type comprising an elevatable platform on which a stack of recording papers is placed. The elevatable paper supply unit 14 may not be always necessary and may be employed as an optional element. The size or weight of each of the recording papers accommodated by the respective paper supply units 21 to 24 can be detected by a respective sensor SE11, SE12, SE13 or SE14. The recording papers in each of the paper supply units 21 to 24 can be successively drawn out therefrom by an associated friction feed roller 25, 26, 27 or 28 one by one and are then fed towards a timing roller pair 30 operable to synchronize the arrival of the respective recording paper at the transfer station with the arrival of the visible powder image carried by the photoreceptor drum 10 at the same transfer station in a manner well known to those skilled in the art. The recording paper onto which the visible powder image has been transferred is subsequently conveyed by a delivery belt 31 towards a fixing unit 32 and is, after the visible powder image has been heated and permanently fixed on the recording paper to provide a complete copy, discharged by a discharge roller pair 33 onto the paper inverting unit 50 positioned exteriorly of the machine housing.

The paper inverting unit 50 has a plurality of capabilities including a capability of feeding one sided copy, i.e., the recording paper having an image copied on one side thereof, into a circulating passage 35 including a plurality of guide roller pairs 36 and 37 so that the opposite side of the recording paper can be formed with another image to eventually render the one sided copy to be a double sided copy or so that such one side of the copying paper can be formed with another image to eventually provide a synthesized copy; and a capability of selecting one of a face-up feed mode (a non-inverting mode), in which the resultant copy can be delivered straight onto the paper storage device 60 in face-up fashion, and a face-down feed mode (an inverting mode) in which the resultant copy can be turned face down.

In order for the paper inverting unit 50 to accomplish any one of the foregoing capabilities, the paper inverting unit 50 is provided with an infeed roller pair 51, an outfeed roller pair 52, switching roller pairs 53 and 54, a re-feed roller pair 55, switching pawls 50 and 57 and a switchback passage 58. Each of the switching pawls 56 and 57 is supported for pivotal movement between two positions and, for this purpose, is adapted to be driven by a respective solenoid unit (not shown).

During a non-inverting mode, the recording paper supplied through the infeed roller pair 51 into the paper inverting unit 50 is guided along an upper face of the switching pawl 56 and is then feed in face-up fashion towards the paper storage device 60 through the outfeed roller pair 52. On the other hand during an inverting mode, the recording paper supplied through the infeed roller pair 51 into the paper inverting unit 50 is guided along a left-hand face of the switching pawl 50 towards the switching roller pair 55 then driven in a positive direction, and reaches the switchback passage 58 through the switching roller pair 54, then driven in a positive direction, after having been guided along a right-hand face of the switching pawl 57. When a rear end of the recording paper reaches an inverting point Q, the switching roller pairs 53 and 54 are reversed to rotate in a reverse direction so that the recording paper can be further fed in face-down fashion into the paper storage device 60 through the outfeed roller pair 52 while guided along a right-hand face of the switching pawl 56 with its rear end serving as a front end.

The paper storage device 60 comprises upper and lower trays 70 and 70*a* positioned one above the other and a paper transport unit 61. Each of the upper and lower trays 70 and 70*a* is supported for movement in a direction substantially perpendicular to the direction of transport of the recording paper and is movable up and down in dependence on the amount of the recording papers discharged onto the respective tray 70 or 70*a*.

The paper transport unit 61 comprises a plurality of delivery roller pairs 61, 63, 64, 56 and 66 and a switching pawl 67 disposed between the delivery roller pairs 62 and 63. The switching pawl 67 is supported for pivotal movement between two positions and is adapted to be driven by a solenoid unit (not shown). This switching pawl 67 has an upper face, along which the recording paper can be guided towards the delivery roller pair 63 and then onto the upper tray 70, and a right-hand face along which the recording paper can be guided towards the delivery roller pair 64 and then onto the lower tray 70*a* through the delivery rollers 65 and 66. A sensor SE1 is disposed following the delivery roller pair 63 for detecting the passage of the recording paper therethrough, and a sensor SE1*a* is disposed following the delivery roller pair for detecting the passage of the recording paper therethrough.

As hereinabove described, each of the upper and lower trays 70 and 70*a* is mounted on a respective box 71 or 71*a* for movement up and down between elevated and lowered positions and for horizontally shifting in a direction substantially perpendicular to the direction in which the recording papers are successively discharged onto the respective tray 70 or 70*a*. For this purpose shift motors 73 and 73*a* and elevating motors 74 and 74*a* are both accommodated within the associated boxes 71 and 71*a* immediately beneath the upper and lower trays 70 and 70*a* and are drivingly coupled with the upper and lower trays 70 and 70*a* through shifting mechanisms and elevating mechanisms (both not shown).

Since the upper and lower trays 70 and 70*a* and their associated peripheral components are of identical structure and reference will be made only to the upper tray 70 in describing the details of each of them. Accordingly, those component parts of and associated with the lower tray 70*a*, which function in substantially the same manner as those of and associated with the upper tray 70 are identified by like reference numerals to which a suffix "*a*" is attached.

Figure 2:
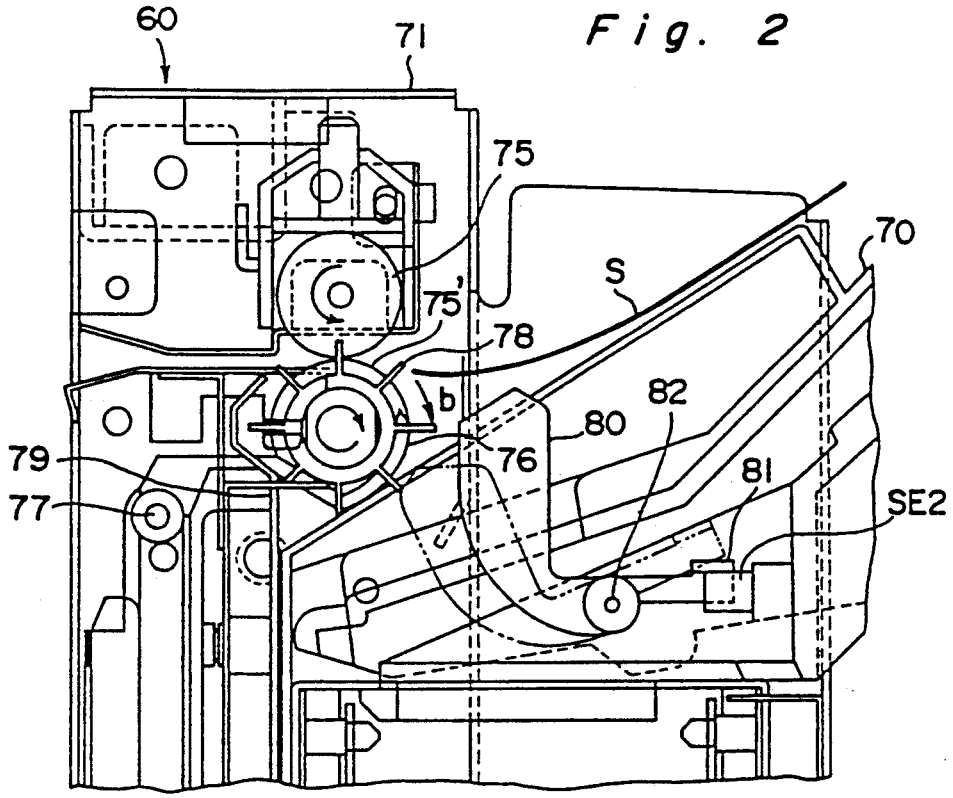
FIG. 2 is a side view of a portion of the paper storage device shown in FIG. 1.

A pair of upper and lower discharge rollers 75 and 75' positioned one above the other within the box 71 is operable to feed the recording paper, delivered from the paper transport unit 61, onto the upper tray 70. As best shown in FIG. 2, a paddle wheel 78 is coaxially mounted on a common shaft for rotation together with the lower discharge roller 75' for applying a biasing force on a rear end of each of the recording papers, successively accommodated in the upper tray 70, in a direction counter to the direction in which the recording papers are successively discharged onto the upper tray 70. This paddle wheel 78 is in the form as comprising a plurality of radially outwardly extending elastic fingers which are, during the rotation of the paddle wheel 78 in a direction shown by the arrow b, successively brought into contact with the rear end of each of the recording papers, which have emerged through the nipping region of the discharge roller pair 75 and then fall by gravity onto the upper tray 70, thereby to apply the biasing force in a direction counter to the direction in which the recording papers are successively accommodated onto the upper tray 70. The recording papers so biased by the paddle wheel 78 in the manner described above are restricted in position by a back-up plate 70 positioned on a lower end of the upper tray 70 in face-to-face relation with the rear ends of the recording papers then stacked on the upper tray 70.

The upper tray 70 has a sensor SE2 supported thereby for detecting the absence or presence of the recording paper on the tray 70. This sensor SE2 has an actuator 80 protruding above a top support surface of the upper tray 70 and adapted to be pivoted clockwise about a pivot pin 82, as viewed in FIG. 2, in response to a loading of the recording paper or papers S on the upper tray 70 to a position shown by the phantom line in FIG. 2 with an end 81 thereof consequently retracted out of an optical path of the sensor SE2. On the other hand, in the event that the recording paper or papers S are removed from the upper tray 70, the actuator 80 returns to the original position, shown by the solid line in FIG. 2, by the effect of its own weight with the end 81 thereof consequently brought in position to intercept the optical path of the sensor SE2.

In order that the top support surface of the tray 70, or the top face of the recording paper or papers resting on the top support surface of the tray 70 if they are on the upper tray 70, can be maintained at a proper position, a sensor SE3 and an actuator 70 are provided for detecting the top support surface of the upper tray 70 and the top face of the recording papers stacked o the top support surface of the tray 70. The proper position referred to above is the position lower than the nipping region of the discharge roller pair 75 at a predetermined distance and has a tolerance. When the support surface of the tray 70 or the top face of the recording papers on the tray 70 is positioned at the proper position, the recording papers successively discharged onto the tray 70 can be orderly disposed by the paddle wheel 78. The sensor SE3 is used to detect if the top support surface of the tray 70 or the top face of the recording papers on the tray 70 is in alignment with an upper limit of the proper position.

The actuator 70 is pivotable about a support pin 77 and has a tip portion so shaped as to follow an outer peripheral surface of the lower discharge roller 75' of the discharge roller pair 75 while positioned above the lower end of the tray 70. This actuator 70 also has a rear end adapted to selectively intercept and retract from an optical path of the sensor SE3. This actuator 70 is normally biased clockwise about the support pin 77 by the effect of its own weight to assume a position shown by the solid line in FIG. 1, in which condition the sensor SE3 is in an OFF state. However, as the recording papers are successively delivered onto the tray 70 with the top face of the stacked recording papers reaching the upper limit of the proper position, the actuator 70 is biased by the top face of the stacked recording papers to pivot somewhat counterclockwise about the support pin 77 with the sensor SE3 consequently brought into an ON state, i.e., switched on, to provide an ON signal. In response to this ON signal, the elevating motor 74 is powered on in a direction required to lower the tray 70 and, therefore, the tray 70 is moved towards the lowered position. The actuator 70 pivots clockwise in response to the lowering of the tray 70 and, when the sensor SE3 is subsequently switched off, the elevating motor 74 is powered off. In this way, when the amount of the recording papers accommodated by the tray 70 increases and the top face of the recording papers stacked on the tray 70 subsequently reaches the upper limit, the support 70 can be lowered stepwise by a predetermined distance.

Whether or not the tray 70 becomes full with the recording papers can be determined by detecting the arrival of the tray 70 at the lowered position by means of an upper sensor SE4 or a lower sensor SE5 positioned at and within a lower region of the box 71. Specifically, the upper sensor SE4 is utilized where the recording papers of relatively large size are successively discharged from the printer 1, whereas the lower sensor SE5 is utilized where the recording papers of relatively small size are successively discharged from the printer 1. The switching between the upper and lower sensors SE4 and SE5 is carried out in response to a size signal supplied from one of sensors SE11, SE12, SE13 and SE14 provided in and for the paper supply units. When one of the upper and lower sensors SE4 and SE5 detects that the tray 70 has become full with the recording paper this condition can be indicated or warned and, at the same time, the printing operation is interrupted or the switching of one tray over to the other tray is carried out.

In the event that the operator removes all of the recording papers stacked on the tray 70 during the use of the printer, the sensor SE2 is switched off to switch the elevating motor 74 on in a direction required to elevate the tray 70 and, therefore, the tray 70 can be moved towards the upper limit of the proper position. On the other hand, in the event that the operator removes some of the recording papers stacked on the tray 70, a paper handling process is allowed to continue and, according to the first preferred embodiment of the present invention now under discussion, unless the upper limit sensor SE3 is switched on even though extra 10 recording papers are successively discharged onto the tray 70, it is determined that the position of the tray 70 is improper, that is, excessively lowered, and therefore, the elevating motor 74 is powered on in a direction required to elevate the tray 70, allowing the tray 70 to be moved towards the elevated position until the upper limit sensor SE3 is switched on. The movement of the support 70 will be described in detail later with reference to the flowchart.

On the other hand, each time a group of information is printed out, the shift motor 73 is driven for a predetermined time to allow the tray 70 to be moved a predetermined pitch in a direction perpendicular to the direction in which the recording papers are successively delivered onto the tray 70 so that, by this reciprocal movement, a group of recording papers can be distributed.

Figure 3:
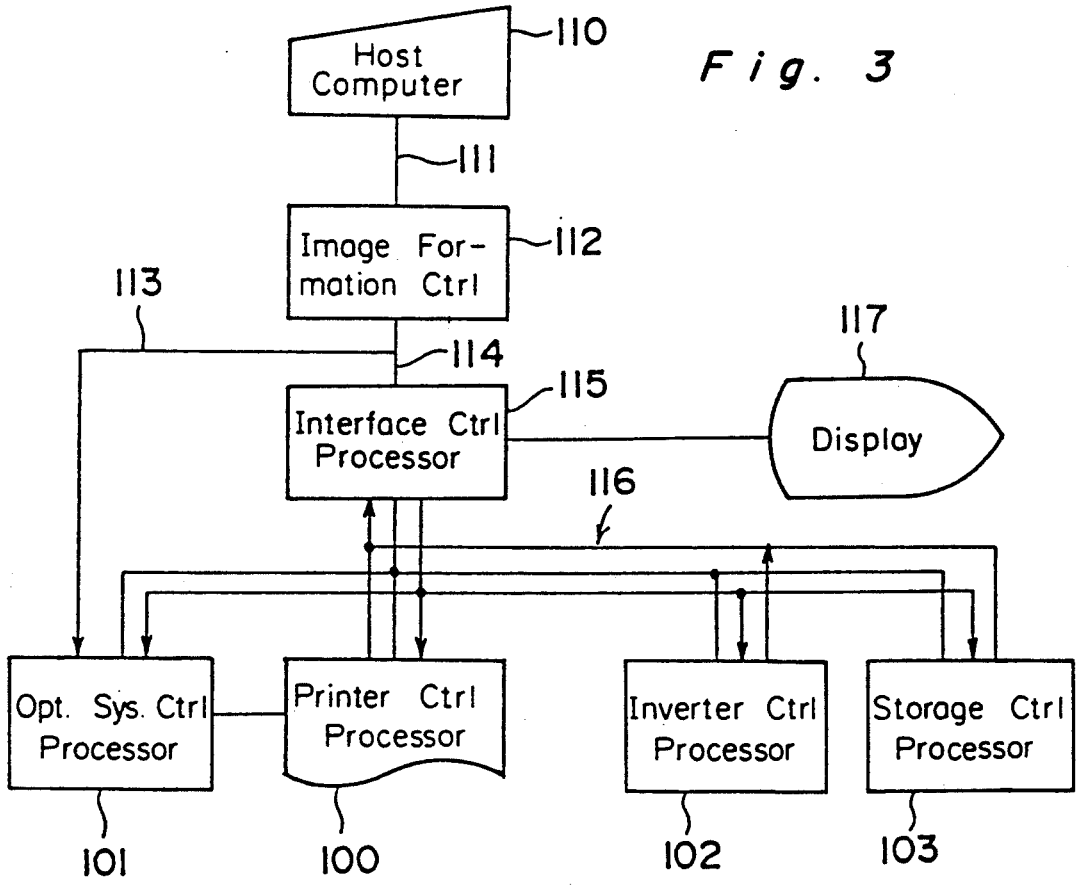
FIG. 3 is a circuit block diagram showing a control circuit used in association with the paper storage device.

A control circuit for the entire system is shown in FIG. 3. As shown therein, the control circuit included in the printer side includes a control processor 100 for controlling the printer 1, a control processor 101 for controlling a laser beam optical system 2 a control processor 102 for controlling the paper inverting unit 50, and a control processor 103 for controlling the paper storage device 60. Print information is transmitted from a host computer 110 to an image formation controller 112 through a host interface 111. The image formation controller 112 is operable to transmit image information to be printed out to the optical system control processor 101 through a video line 113 and also to transmit print mode and others to an interface control processor 115 through a control line 114. This interface control processor 115 communicates through serial interfaces 116 with the various processors 100 to 103 as to the various modes. The interface control processor 115 is also operable to control an ON-OFF switching of a display device 117 disposed at an operating panel on the printer machine housing. The display device 117 is used to provide a visual indication of respective states of the processors 100 to 103 in response to instructions given by the interface control processor 115.

The control sequence of the processor 103 used to control the paper storage device 60 will now be described with particular reference to FIGS. 4 to 8.

Figure 4:
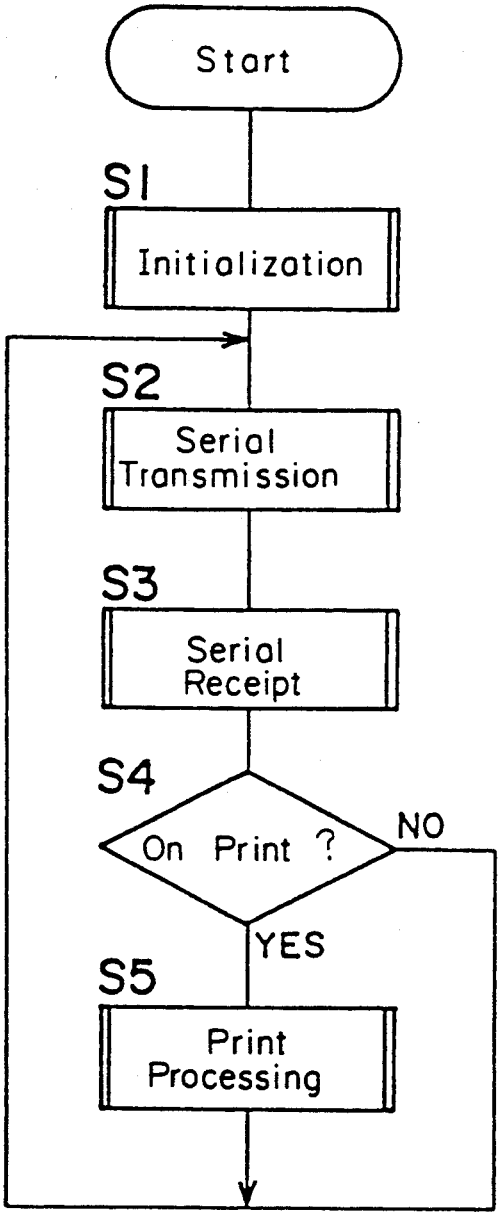

FIG. 4 illustrates a main routine. When the supply of an electric power is effected with the program consequently started, initialization takes place at step S1 during which various flags timers and counters are reset. Then, at successive steps S2 and S3, communication takes place with the other processors 100, 101, 102 and 115 through the serial interfaces 116, followed by step S4 at which a decision is made to determine if the sequence control of the printing process is initiated. If the result of decision at step S4 indicates that the sequence control is initiated, a subroutine for the print processing is executed at step S5.

FIG. 4 illustrates the details of the subroutine executed at step S5. During the execution of the subroutine of FIG. 4, a control for lowering the tray 70, a control for controlling a counter used to count the number of the recording papers accommodated by the tray 70, a control for elevating the tray 70 and other controls (for example, paper transport and detection of a paper jamming) are executed at respective steps S11, S12, S13 and S14.

Figure 5:
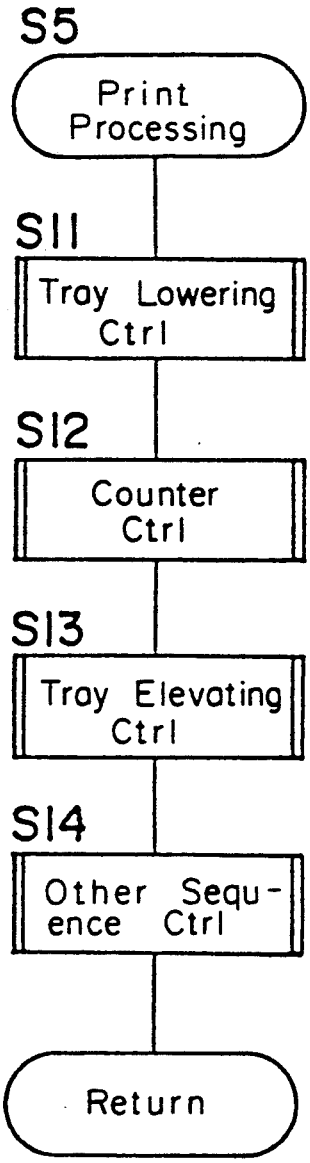

The subroutine for the tray lowering control executed at step S11 of the flowchart of FIG. 5 is illustrated in detail in FIG. 6. As shown therein, subsequent to the start of the subroutine of FIG. 6, a decision is made at step S21 to determine if the upper limit sensor SE3 is switched on and, if it is switched on, that is, if the top face of the recording papers on the tray 70 has reached the upper limit of the proper position, a flag A is set to 1 at step S22. The flag A is used to indicate that the tray 70 is being lowered, and if it is set to 1, the elevating motor 74 is driven in a lowering direction at step S23 to lower the tray 70. On the other hand, if the result of decision at step S21 indicates that the upper limit sensor SE3 is switched off the flag is reset to zero at step S24, followed by step S25 at which the elevating motor 74 is powered off, Accordingly, the tray 70 being lowered can be held still at this timing and retained in position until the upper limit sensor SE3 is switched on as a result of an increase of the amount of the recording papers subsequently accommodated by the tray 70.

The counter control subroutine executed at step S11 of the flowchart of FIG. 5 is shown in detail in FIG. 7. Subsequent to the start of this subroutine, a decision is made at step S31 to determine if a flag is 1. This flag B is used to indicate that the position of the tray 70 is improper (See steps S35 and S36.) and, if it is set to 1, that is, if the position of the tray 70 is improper, this subroutine is immediately terminated. On the other hand, if this flag B is reset to zero, another decision is made at step S32 to determine if the discharge sensor SE1 disposed at a position immediately following the discharge roller pair 75 is on an OFF edge, that is, to determine if the rear end of the recording paper has been transported past the sensor SE1. In the first preferred embodiment of the present invention, when the sensor SE1 is on the OFF edge, it is deemed that a single recording paper has been discharged onto and accommodated by the tray 70. Should the result of decision at step S32 be "YES" the program flow proceeds to step S33 at which a further decision is made to determine if the flag A is set to 1, but if it is "NO", a further decision is made at step S37 to determine if the flag A is set to 1. In the event that the flag A is deemed as set to 1 at each of steps S33 and S37, it means that the tray 70 is being lowered and, therefore, step S38 takes place at which a counter is cleared, terminating the subroutine of FIG. 7. Unless a further discharge of recording papers takes place, this subroutine is also terminated even though the flag A is reset to zero (as indicated by "NO" at steps S52 and S37).

On the other hand, if the further recording paper is discharged and the flag A is reset to zero (as indicated by "YES" at step S32 and by "NO" at step S33), the counter is incremented by 1 at step S34, followed by a decision at step S35 to determine if the count of the counter is "10". If the count reaches "10", the flag B is set to 1 at step S36, followed by termination of this subroutine.

Figure 8:
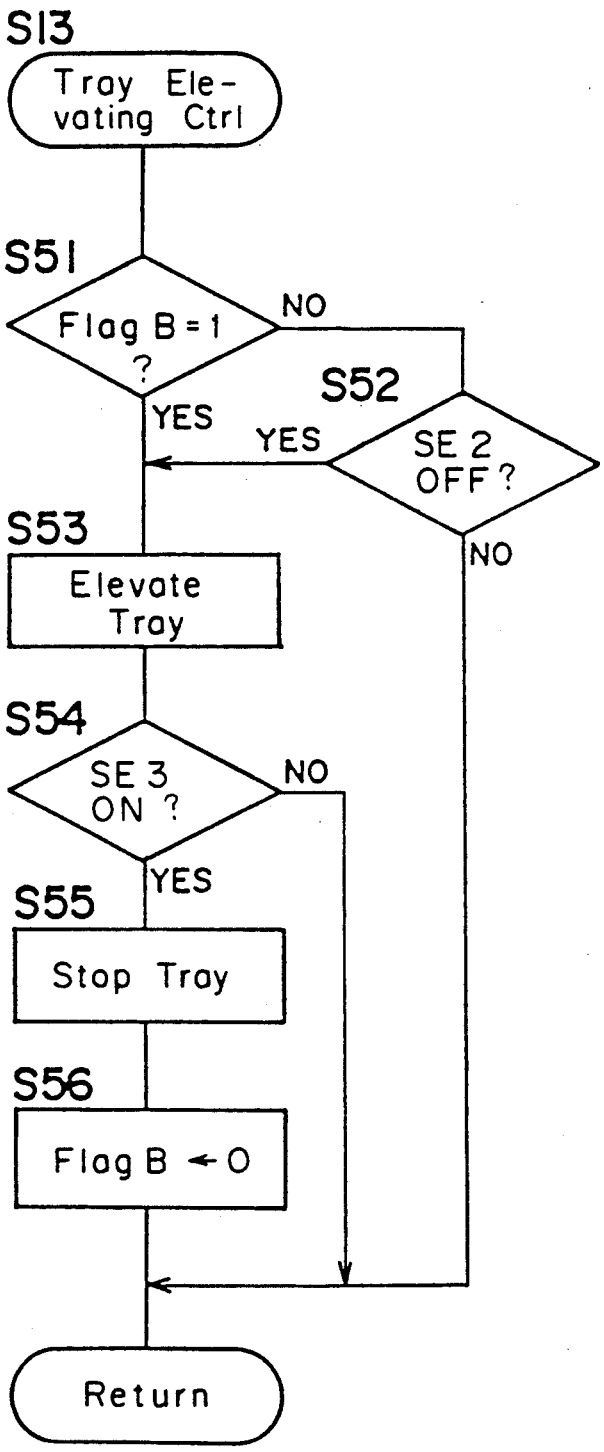

FIG. 8 illustrates the details of the tray elevating control subroutine executed at step S13 of the flowchart of FIG. 5. Subsequent to the start of this subroutine, a decision is made at step S51 to determine if the flag B is set to 1, and if it is set to 1, that is, when the number of the recording papers accommodated on the tray 10 subsequent to the lowering of the tray 70 reaches 10, it means that the tray 70 has been excessively lowered below the proper position and, therefore, the elevating motor 74 is powered on in an elevating direction at step S53 to elevate the tray 70. Where the result of decision at step S52 indicates that the sensor SE2 is switched off even though the flag B is reset to zero, it means that all of the recording papers are removed from the tray 70 and, therefore, the elevating motor 74 is similarly driven in the elevating direction at step S53 to elevate the tray 70. Then, if the fact that the sensor SE3 has been switched on is confirmed at step S54, the elevating motor 74 is powered off. In this way, the tray 70 can be set at a proper upper limit position and, therefore, the flag B is reset to zero at step S56, followed by termination of this subroutine.

Thus, in the illustrated first embodiment of the present invention, if the upper limit sensor SE3 is switched on at step S21 (that is, if the top face of the recording papers reaches the upper limit of the proper position) by the time the count of the counter attains "10" the flag A is set to 1 and the lowering of the tray 70 is initiated at step S23. In general, through this routine the counter is cleared at step S38 and the position of the tray 70 is properly controlled. However if the recording papers on the tray 70 is partly removed with the top face of the recording papers consequently lowered below a lower limit of the proper tolerance, the tray 70 will not be elevated (as indicated by "NO" at each of steps S51 and S52, in which case the subroutine of FIG. 7 is terminated) up until the count of the counter reaches "10" unless the top face of the recording papers is detected by the upper limit sensor SE3 during the counting operation of the counter. Only when and after the tenth recording paper has been accommodated on the tray 70, the position of the tray 70 is deemed as improper and, therefore, the tray 70 is elevated to the upper limit of the proper position.

By the foregoing control, even though the recording papers on the tray 70 are partly removed therefrom, a load imposed on the motor 74 and others can be reduced with no need to elevate the tray 70. However, where the top face of the recording papers on the tray 70 is excessively lowered more than necessary, the tray 70 is elevated to bring it to the proper position, thereby avoiding any possibility that the recording papers may be disordered on the tray 70.

Figure 9:
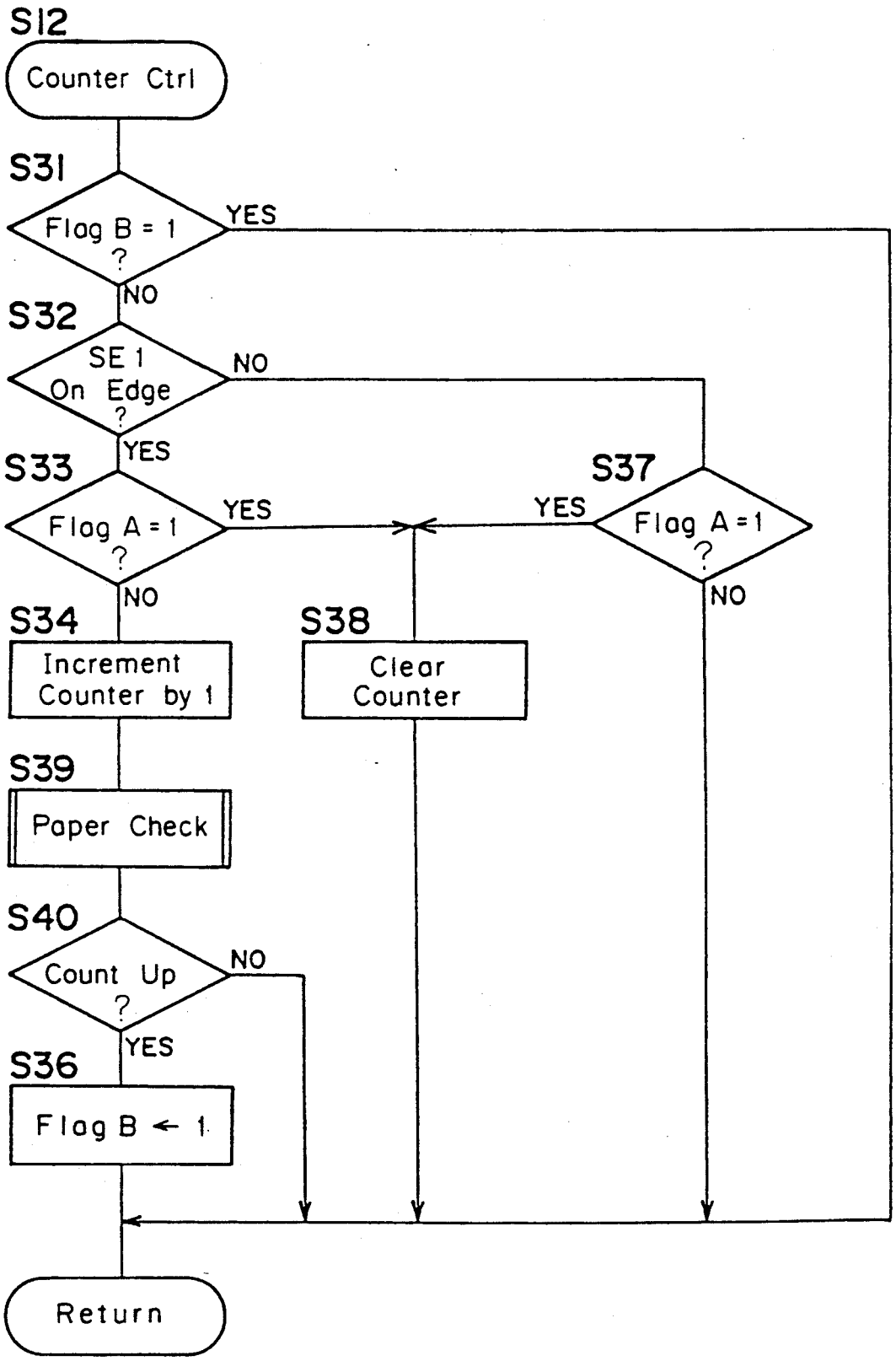
FIGS. 9 and 10 are flowcharts showing the sequence of operation of the paper storage device according to a second preferred embodiment of the present invention.
Figure 10:
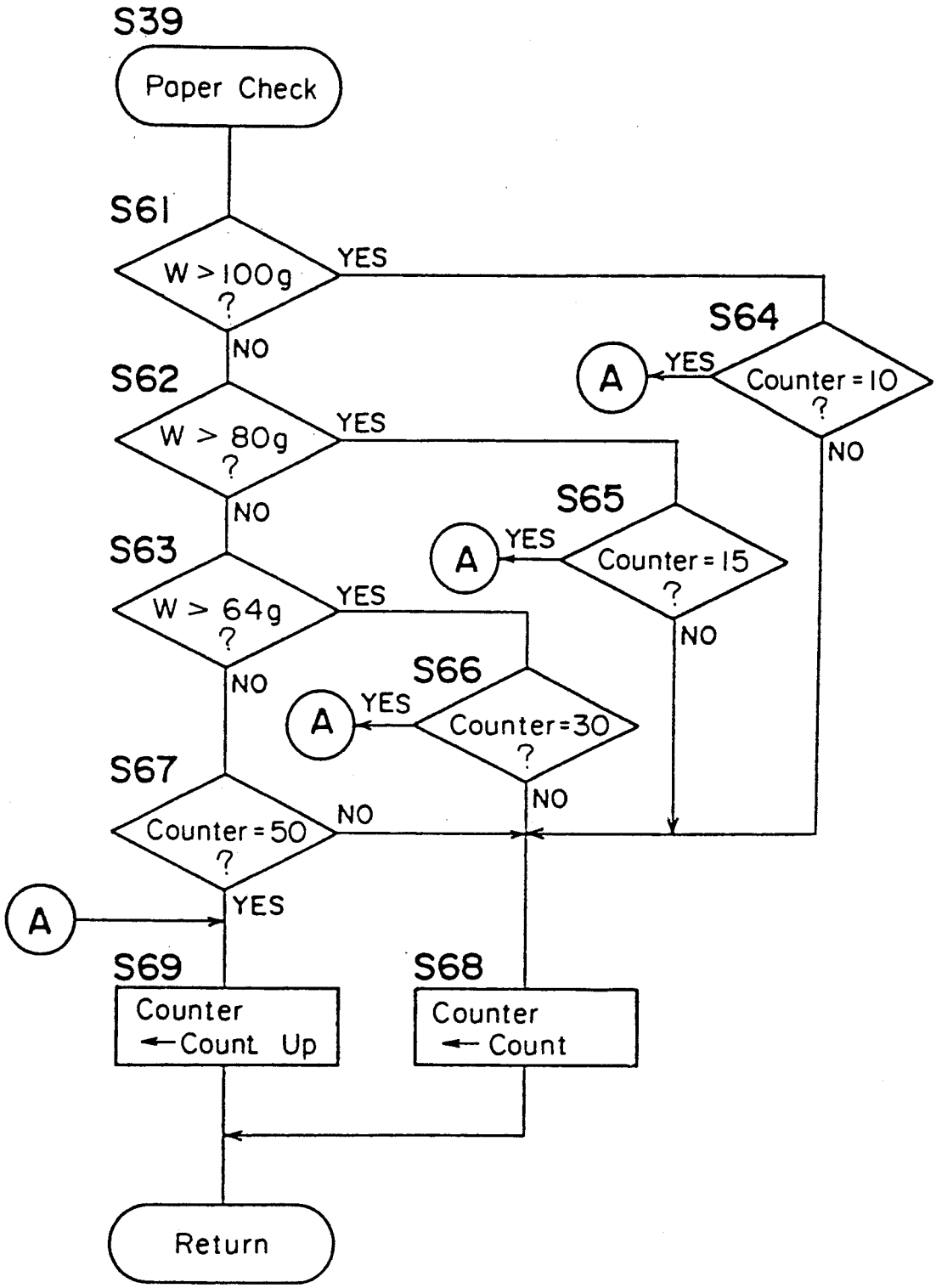

Second Embodiment: FIGS. 9 and 10

The paper storage device according to a second preferred embodiment of the present invention is similar in structure to that shown in and described with reference to FIGS. 1 to 3 and, however, operates according to a control sequence wherein the count of the counter which provides the basis for the movement of the tray 70 between the elevated and lowered positions is made variable according to the basis weight of the recording paper. It is to be noted that the basis weight of the recording paper corresponds to the thickness thereof and the count of the counter is selected to be of a relatively great value if the recording paper is thin, that is, the basis weight thereof is small. By so doing, the tray 70 can be elevated when the drop height referred to hereinbefore becomes substantially equal, regardless of the thickness of each of the recording papers on the tray 70.

More specifically, the paper storage device according to the second preferred embodiment of the present invention is controlled based on such a counter control subroutine as shown in FIG. 9 and such a paper check subroutine as shown in FIG. 10, in addition to the flowcharts shown in and described with reference to FIGS. 4, 5, 6 and 8.

Referring to FIG. 9, subsequent to the start of the counter control subroutine, and at step S39 following step S34 at which the counter is incremented, the basis weight of the recording paper used in the printer for printing images thereon is checked. Then, at subsequent step S40 a decision is made to determine if the counter has counted up based on the basis weight checked at step S39. If the counter has counted up, the flag B is set to 1 at step S36. The other subroutine steps shown in FIG. 9 are similar to those shown in FIG. 7 and, therefore, the details thereof will not be reiterated for the sake of brevity.

In the subroutine shown in FIG. 10, respective decisions are made at steps S61, S62 and S63 to determine if the basis weight of the recording paper is greater than 100 grams, 80 grams and 64 grams. The basis weight of the recording paper can be determined on the basis of a signal supplied from any one of the sensors SE11, SE12, SE13 and SE14 associated with the paper supply units in the printer, or an input signal inputted by the operator. If the result of decision at each step S61, S62 and S63 indicates "YES", another decision is made at step S64, S65 and S66 to determine if the count of the counter is 10, 15 and 30, respectively, but if the result of decision at each step S61, S62 and S63 indicates "NO", the basis weight of the recording paper is deemed as smaller than 64 grams and, accordingly, at step S67 a decision is made to determine of the count of the counter is 50. Thus, if the result of decision at each step S64 to S67 indicates "NO", the operation of the counter is continued at step S68, but if it indicates "YES", it means that the top face of the recording papers on the tray 70 is lower than the proper position and, therefore, the counter counts up at step S69. Based on the count-up at step S69, the flag B is set to 1 at step S36, followed by execution of steps S55 to S56 of the flowchart of FIG. 8.

Figure 12:
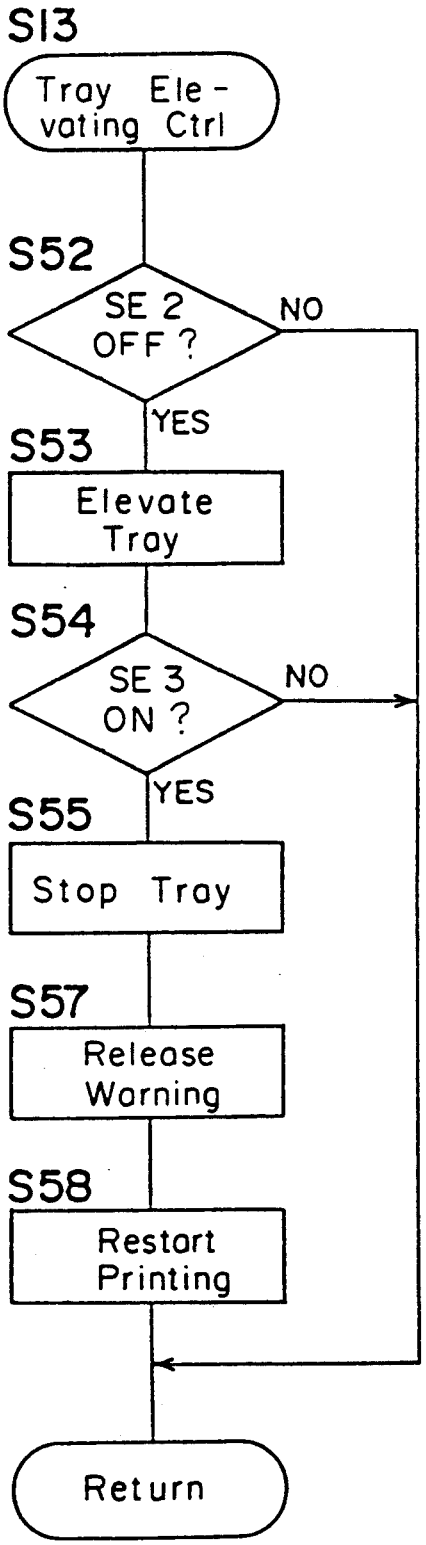
FIGS. 11 and 12 are flowcharts showing the sequence of operation of the paper storage device according to a second preferred embodiment of the present invention.
Figure 11:
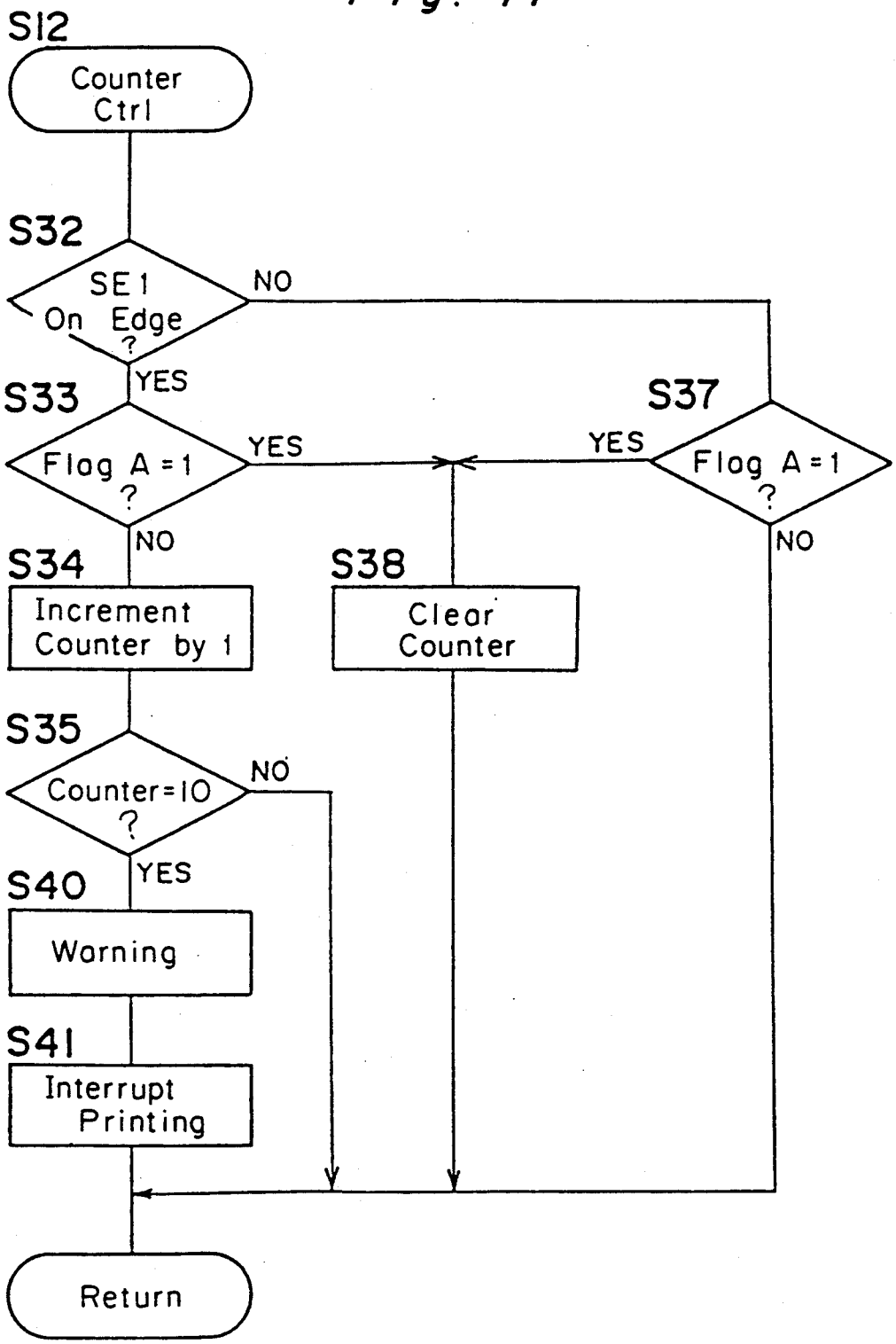

Third Embodiment: FIGS. 11 and 12

The paper storage device according to a third preferred embodiment of the present invention is similar in structure to that shown in and described with reference to FIGS. 1 to 3 and, however, operates according to a control sequence wherein when the top face of the recording papers on the tray is excessively lowered below the proper position a warning is issued and, at the same time, the printing operation in the printer 1 is interrupted, instead of the tray 70 being elevated as is the case with any one of the foregoing preferred embodiments.

More specifically, the paper storage device according to the third preferred embodiment of the present invention is controlled based on such a counter control subroutine a shown in FIG. 11 and such a tray elevating control subroutine as shown in FIG. 12, in addition to the flowcharts shown in and described with reference to FIGS. 4, 5 and 6.

Referring to the subroutine of FIG. 11, instead of the use of the flag B for elevating the tray 70, steps S32 to S35 are executed and, if the count of the counter attains 10 at step S35, a warning signal is issued at step S40 and the printing operation is interrupted at step S41. The warning signal is communicated to the interface control processor 115 of FIG. 3 so that light emitting diodes in the display unit 117 can be lit to provide an visual warning indication. A stop signal necessary to interrupt the printing operation is also communicated to the control processor 100 so that the latter can control the printer 1 to interrupt the printing operation.

Referring now to the subroutine shown in FIG. 12, steps S52 to S55 shown therein are similar to those shown in FIG. 8. After step S55, and subsequent to the elevation of the tray 70, the warning is released at step S57 followed by a restart of the printing operation at step S58.

Although the present invention has been described in connection with the preferred embodiments thereof with reference to the accompanying drawings, it is to be noted that various changes and modifications are apparent to those skilled in the art. For example, the second and third preferred embodiments can be combined in the practice of the present invention. Also, the shifting motion of each of the trays 70 and **70*a*** is not always essential in the practice of the present invention.

Accordingly, such changes and modifications are to be understood as included within the scope of the present invention as defined by the appended claims, unless they depart therefrom.

What is claimed is:

1. A paper storage device for receiving recording papers successively discharged from an image forming apparatus and for accommodating the recording papers in a stacked fashion, which comprises:

a tray for accommodating the recording papers;

a drive means for driving the tray up and down;

means for detecting an arrival of a top face of the recording papers on the tray at a predetermined height;

a control means for lowering the tray on the basis of an output from the detecting means;

means for counting the number of the recording papers delivered onto the lowered tray from the image forming apparatus; and means for determining that a position of the tray is improper when the number of the recording papers counted by the counting means reaches a predetermined value and the top face of the recording papers on the tray has not yet reached the predetermined height.

2. The paper storage device as claimed in claim 1, further comprising a second determining means for determining the type of each of said recording papers and means and for changing the predetermined value of the number of recording papers on the basis of a result of a decision made by said second determining means.

3. The paper storage device as claimed in claim 1, further comprising means for elevating the tray when the determining means determines that the position of the tray is improper.

4. The paper storage device as claimed in claim 1, further comprising means for issuing a warning in the event that the position of the tray is determined improper.

5. The paper storage device as claimed in claim 1, further comprising means for determining the absence or presence of the recording papers on the tray and a control means for elevating the tray to the predetermined height in the event of the absence of the recording papers on the tray.

6. The paper storage device as claimed in claim 1, wherein said control means for lowering the tray terminates a lowering operation at a timing when an output from the detecting means is OFF.

7. A paper storage device for receiving recording papers successively discharged from an image apparatus through a discharge opening and for accommodating the recording papers in a stacked fashion, which comprises:

a tray for accommodating the recording papers;

a drive means for driving the tray up and down relative to the discharge open of the image forming apparatus;

means for detecting an excess of a top face of the recording papers on the tray over a predetermined position defined below the discharge mouth;

a control means for controlling said drive means to lower said tray until the top face of the recording papers on the tray is lowered below the predetermined position;

means for counting the number of the recording papers delivered onto the lowered tray from the image forming apparatus through the discharge opening;

a reset means for resetting a count of the counting means when the detecting means detects the excess of the top face of the recording papers on the tray over the predetermined position; and means for determining that a position of the tray is improper when the number of the recording papers counted by the counting means reaches a predetermined value.

8. The paper storage device as claimed in claim 7, further comprising a second means for controlling the drive means so a to elevate the tray when said determining means determines that the position of the tray is improper.

9. The paper storage device as claimed in claim 8, wherein said second control means brings the drive means to a halt when the detecting means detects the excess of the top face of the recording papers on the tray over the predetermined position.

* * * * *

UNITED STATES PATENT AND TRADEMARK OFFICE

CERTIFICATE OF CORRECTION

PATENT NO. : 5,188,354

DATED : February 23, 1993

INVENTOR(S) : Kiyoshi Emori

It is certified that error appears in the above-indentified patent and that said Letters Patent is hereby corrected as shown below:

In col. 1, line 53, change "00-137764" to --60-137764--.

In col. 4, line 13, change "10" to --16--.

In col. 4, line 67, change "50" to --56--.

In col. 5, line 12, change "50" to --56--.

In col. 5, line 13, change "55" to --53--.

In col. 5, line 34, change "56" to --65--.

In col. 5, line 48, after "pair" insert --66--.

In col. 6, line 28, change "70" (first occurrence) to --79--.

In col. 6, line 51, change "70" to --76--.

In col. 6, line 53, change "o" to --on--.

In col. 6, line 66, change "70" to --76--.

In col. 7, line 2, change "70" (second occurrence) to --76--.

In col. 7, lines 4, 11 and 19, change "70" to --76--.

UNITED STATES PATENT AND TRADEMARK OFFICE

CERTIFICATE OF CORRECTION

PATENT NO. : 5,188,354

DATED : February 23, 1993

INVENTOR(S) : Kiyoshi Emori

It is certified that error appears in the above-indentified patent and that said Letters Patent is hereby corrected as shown below:

In col. 9, line 36, change "S52" to --S32--.

In col. 11, line 18, change "of" (first occurrence) to --if--.

In col. 11, line 44, change "a" (first occurrence) to --as--.

In col. 12, line 58 (claim 7, line 2), after "image" insert --forming--.

\In col. 12, line 64 (claim 7, line 8), change "open" to --opening--.

In col. 14, line 5 (claim 8, line 3), change "a" to --as--.

Signed and Sealed this

Seventh Day of December, 1993

*Attest:*

*Attesting Officer*

BRUCE LEHMAN

*Commissioner of Patents and Trademarks*